US007172068B1

(12) United States Patent
Griffin et al.

(10) Patent No.: US 7,172,068 B1
(45) Date of Patent: Feb. 6, 2007

(54) CIRCULAR SAW BLADE STORAGE APPARATUS

(76) Inventors: Jeffrey M. Griffin, 4717 Ora St., Lansing, MI (US) 48910; Sandra L. Perez, 4717 Ora St., Lansing, MI (US) 48910

( * ) Notice: Subject to any disclaimer, the term of this patent is extended or adjusted under 35 U.S.C. 154(b) by 328 days.

(21) Appl. No.: 10/797,536

(22) Filed: Mar. 11, 2004

(51) Int. Cl.
*A45C 11/26* (2006.01)

(52) U.S. Cl. ..... 206/349; 206/372; 206/454

(58) Field of Classification Search ..... 206/349, 206/372, 394, 454, 477, 445, 303
See application file for complete search history.

(56) References Cited

U.S. PATENT DOCUMENTS

| | | | | | |
|---|---|---|---|---|---|
| D60,651 | S | | 3/1922 | Farrington | |
| 2,292,721 | A | * | 8/1942 | Stanton | 206/445 |
| 2,697,460 | A | * | 12/1954 | Barnett | 144/285 |
| 2,697,480 | A | | 12/1954 | Barnetti | |
| 2,822,081 | A | * | 2/1958 | Mitchell | 206/303 |
| 3,053,424 | A | * | 9/1962 | Reinhard | 294/163 |
| 3,804,238 | A | | 4/1974 | Howard | |
| 3,870,148 | A | * | 3/1975 | Hite | 206/372 |
| 4,416,372 | A | * | 11/1983 | Polk | 206/372 |
| 4,640,416 | A | * | 2/1987 | Northrup et al. | 206/425 |
| 4,819,798 | A | * | 4/1989 | Hasuike | 206/307.1 |
| 4,896,771 | A | * | 1/1990 | Edwards | 206/349 |
| 5,193,680 | A | * | 3/1993 | Schumann et al. | 242/423.1 |
| 5,632,374 | A | * | 5/1997 | Fitzsimmons et al. | 206/308.1 |
| 5,782,356 | A | * | 7/1998 | Hugg | 206/454 |
| 5,901,846 | A | | 5/1999 | Betcher | |
| 5,927,493 | A | | 7/1999 | Colombo | |
| 6,068,272 | A | | 5/2000 | Eskelinen | |

* cited by examiner

*Primary Examiner*—Mickey Yu
*Assistant Examiner*—Steven Pollicoff

(57) ABSTRACT

A circular saw blade storage apparatus includes a panel having a first edge, a second edge, a third edge and a fourth edge. The first and second edges are positioned opposite of each other. A first housing is hingedly coupled to the first edge and a second housing is hingedly coupled to the second edge. The first and second housings each have a top side having a plurality of slots therein. The first and second housings may each be positioned on the panel so that the top sides face each other. Each of a plurality of saw blades may be removably extended into one of the slots so that the blades are stored within the housing.

13 Claims, 3 Drawing Sheets

CIRCULAR SAW BLADE STORAGE APPARATUS

BACKGROUND OF THE INVENTION

1. Field of the Invention

The present invention relates to tool storing devices and more particularly pertains to a new tool storing device for storing a plurality of circular saw blades in a manner that prevents the saw blades from abutting each other.

2. Description of the Prior Art

The use of tool storing devices is known in the prior art. U.S. Pat. No. 3,804,238 describes a device for storing in a portable case a plurality of saber saw blades. Another type of tool storing device is U.S. Pat. No. 2,697,460 having a housing for holding a plurality of tools and includes a post for holding a plurality of circular saw blades so that they are stacked on each other. U.S. Pat. No. 5,901,846 describes a shipping case for holding and shipping cutting blades.

While these devices fulfill their respective, particular objectives and requirements, the need remains for a device that holds a plurality of circular saw blades so that they may be easily stored and transported. The device should include a means of separating the blades so that the blades are not damaged by their contact during transportation.

SUMMARY OF THE INVENTION

The present invention meets the needs presented above by generally comprising a panel that has a generally rectangular shape and has a first edge, a second edge, a third edge and a fourth edge. The first and second edges are positioned opposite of each other. A first housing has a bottom side, a top side, a inner side, an outer side and a pair of lateral sides. The top side of the first housing has a plurality of slots therein. A juncture of the inner and bottom sides of the first housing is hingedly coupled to the first edge. A second housing has a bottom side, a top side, a inner side, an outer side and a pair of lateral sides. The top side of the second housing has a plurality of slots therein. A juncture of the inner and bottom sides of the second housing is hingedly coupled to the second edge. Each of the inner sides of the first and second housings may be abutted against the panel such that the top sides of the first and second housings are directed toward each other and a closed position is defined. Each of a plurality of saw blades may be removably extended into one of the slots.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
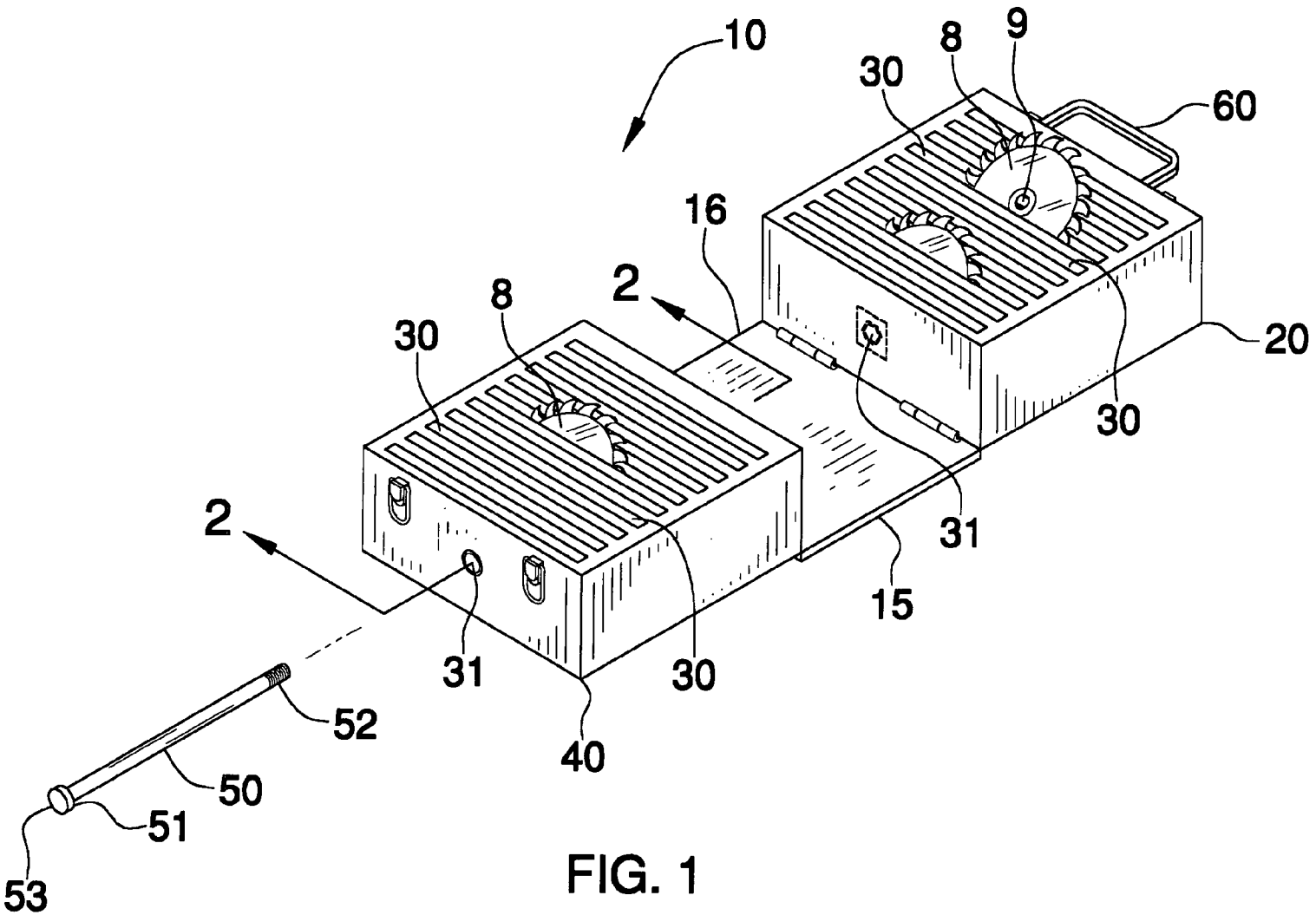
FIG. 1 is a perspective view of a circular saw blade storage apparatus in an open position according to the present invention.
Figure 2:
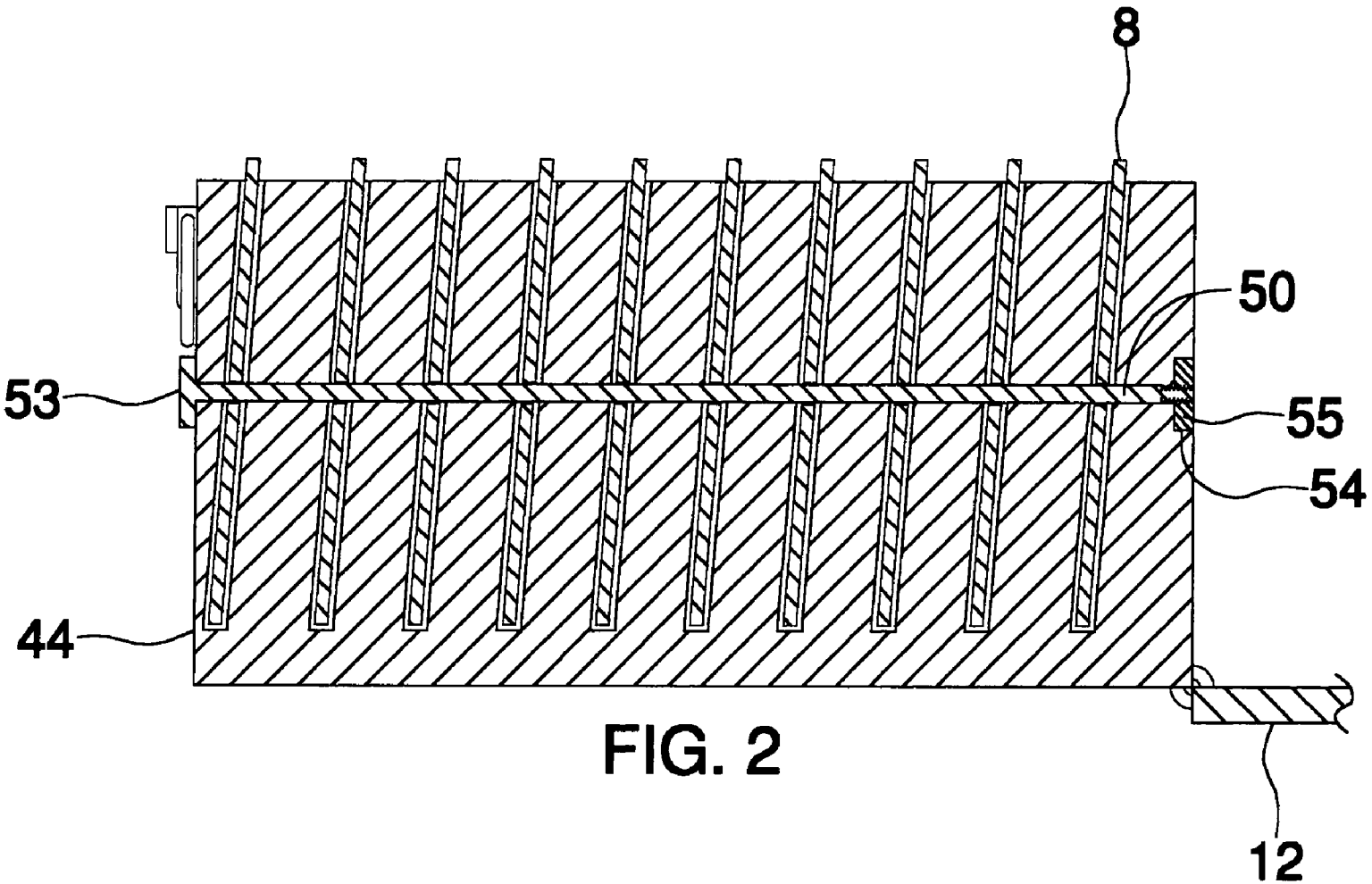
FIG. 2 is a cross-sectional view taken along line 2—2 of FIG. 1 of the present invention.
Figure 3:
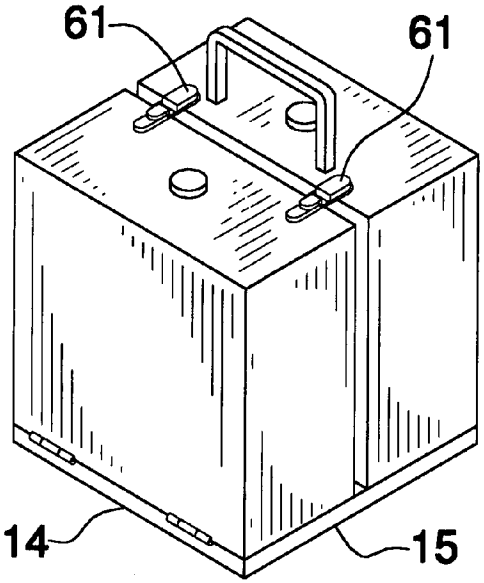
FIG. 3 is a perspective view of the present invention in a closed position.
Figure 4:
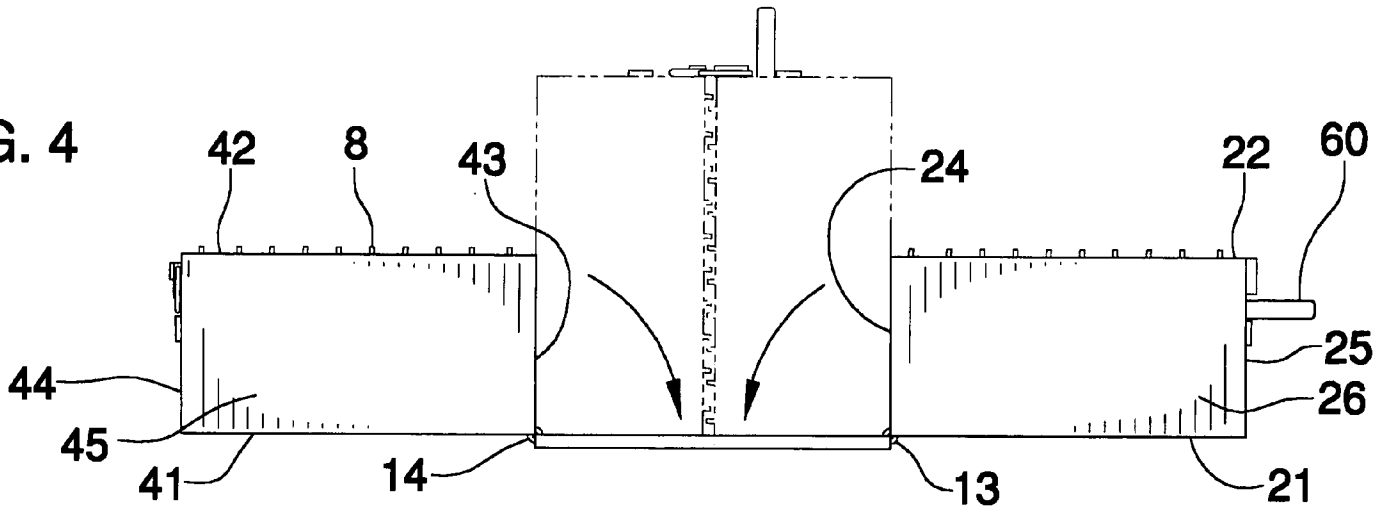
FIG. 4 is a side view of the present invention.

With reference now to the drawings, and in particular to FIGS. 1 through 4 thereof, a new tool storing device embodying the principles and concepts of the present invention and generally designated by the reference numeral 10 will be described.

As best illustrated in FIGS. 1 through 4, the circular saw blade storage apparatus 10 generally comprises a panel 12 that has a generally rectangular shape and has a first edge 13, a second edge 14, a third edge 15 and a fourth edge 16. The first 13 and second 14 edges are positioned opposite of each other.

A first housing 20 has a bottom side 21, a top side 22, a inner side 24, an outer side 25 and a pair of lateral sides 26. The top side 22 of the first housing 20 has a plurality of slots 30 therein. Each of the slots 30 is orientated perpendicular to the lateral sides of the first housing 20. A juncture of the inner 24 and bottom 21 sides of the first housing 20 is hingedly coupled to the first edge 13. Each of the slots 30 in the first housing 20 is angled from the inner side 24 to the outer 25 side as each of the slots 30 extends toward the bottom side 21. The first housing 20 has an aperture 31 extending therethrough. The aperture 31 extends into the outer side 25 and outwardly through the inner side 24. The aperture 31 is generally centrally located in the outer 25 and inner 24 sides such that the aperture 31 extends through each of the slots 30 in the first housing 20.

A second housing 40 is substantially identical to the first housing 20 and includes a bottom side 41, a top side 42, a inner side 43, an outer side 44 and a pair of lateral sides 45. The top side 42 of the second housing 40 has a plurality of slots 30 therein. Each of the slots 30 is orientated perpendicular to the lateral sides 45 of the second housing 40. A juncture of the inner 43 and bottom 41 sides of the second housing 40 is hingedly coupled to the second edge 14. Each of the slots 30 in the second housing 40 is angled from the inner side 43 to the outer side 44 as each of the slots 30 extends toward the bottom side 41. The second housing 40 has an aperture 31 extending therethrough. The aperture 31 extends into the outer side 44 and outwardly through the inner side 43. The aperture 31 is generally centrally located in the outer 44 and inner 43 sides such that the aperture 31 extends through each of the slots 30 in the second housing 40. Each of the inner sides 24, 43 of the first 20 and second 40 housings may be abutted against the panel 12 such that the top sides 22, 42 of the first 20 and second 40 housings are directed toward each other and a closed position is defined. The inner surfaces 24, 43 of the first 20 and second 40 housings are preferably spaced from each other when the first 20 and second 40 housings are in the closed position. The slots 30 in the first housing 20 are staggered with respect to the slots 30 in the second housing 40 when the top sides 22, 42 are facing each other.

Each of a plurality of saw blades 8 may be removably extended into one of the slots 30. Openings 9 extend through each of the blades 8 and are conventional for mounting the blades 8 on an electric saw. The openings 9 may be aligned with a corresponding one of the one of the apertures 31. Each the slots 30 in the first 20 and second 40 housings has a depth adapted for receiving the saw blades 8 such that the saw blades 8 extend between 0.25 inches and 1.50 inches away from a respective one of the top sides 22, 42. Thus, for example, slots 30 for 10 inch blades will have a depth between 8.50 inches and 9.75 inches. This ensures that the blades 8 are easily gripped by their portions extending above the respective top sides 22, 43.

Each of a pair of rods 50 is removably extendable through one of the apertures 31 and through aligned ones of the openings 9 such that the saw blades 8 are releasably secured in the slots 30. Each of the rods 50 has a first end 51 having a head 53 attached thereto and a second end 52 that is threaded. When extended through the first 20 and second 40 housings, the heads 53 may be abutted against one of the outer sides 25, 44 such that the second ends 52 are positioned adjacent to a corresponding one of the inner sides 24, 43. Each of the inner sides 24, 43 has a depression 54 therein. The depressions 54 are positioned such that each of the apertures 31 extends through one of the depressions 54. Each of a pair of nuts 55 is positionable in one of the depressions 54 and threadably coupled to one of the second ends 52 of the rods 50. The rods 50 may be unthreaded from the nuts 55 to remove them from the housings 20, 40. Also, the nuts 55 may be secured in the depressions 54 so that they do not fall away from the housings 20, 40 when the rods 50 are removed.

A handle 60 is attached to the outer surface 25 of the first housing 20. A latch assembly 61 is attached to the first 20 and second 40 housings for selectively securing the first 20 and second 40 housings in the closed position. The latch assembly 61 preferably includes a pair of buckles attached to the outer sides 25, 44 of the first 20 and second 40 housings.

In use, the first 20 and second 40 housings are used for storing a plurality of circular saw blades 8. The rods 50 are extended through the first 20 and second 40 housings and through the saw blades 8 for securing the saw blades 8 within the housings 20, 40. The slots 30 are staggered to ensure that the blades 8 do not rub against each other when the first 20 and second 40 housings are placed in the closed position.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A container assembly adapted for holding a plurality circular saw blades, said assembly comprising:

a panel having a generally rectangular shape and having a first edge, a second edge, a third edge and a fourth edge, said first and second edges being positioned opposite of each other;

a first housing having a bottom side, a top side, a inner side, an outer side and a pair of lateral sides, said top side of said first housing having a plurality of slots therein, a juncture of said inner and bottom sides of said first housing being hingedly coupled to said first edge;

a second housing having a bottom side, a top side, a inner side, an outer side and a pair of lateral sides, said top side of said second housing having a plurality of slots therein, a juncture of said inner and bottom sides of said second housing being hingedly coupled to said second edge, wherein each of said inner sides of said first and second housings may be abutted against said panel such that said top sides of said first and second housings are directed toward each other and a closed position is defined, each of said slots in said first housing being staggered with respect to said slots in said second housing when said top sides are facing each other;

wherein each of a plurality of saw blades may be removably extended into one of said slots, wherein each of the saw blades positioned in said first housing are interspersed between adjacent ones of the saw blades in said second housing due to said slots in said first housing being vertically staggered with respect to said slots in said second housing.

2. The assembly according to claim 1, wherein each of said slots in said first and second housings each being orientated perpendicular to lateral sides of said first and second housings.

3. The assembly according to claim 2, wherein said first housing has an aperture extending therethrough, said aperture extending into said outer side and outwardly through said inner side of said first housing, said aperture being generally centrally located in said outer and inner sides such that said aperture extends through each of said slots in said first housing, said second housing having an aperture extending therethrough, said aperture extending into said outer side and outwardly through said inner side of said second housing, said aperture being generally centrally located in said outer and inner sides such that said aperture extends through each of said slots in said second housing, openings extending through each of the blades may be aligned with a corresponding one of said one of said apertures, each of a pair of rods being removably extendable through one of said apertures and through aligned ones of said openings such that the saw blades are releasably secured in said slots.

4. The assembly according to claim 3, wherein each of said rods has a first end having a head attached thereto and a second end being threaded, wherein said head may be abutted against one of said outer sides such that said second end is positioned adjacent to a corresponding one of said inner sides, each of said inner sides has a depression therein, said depressions being positioned such that each of said apertures extends through one of said depressions, each of a pair of nuts being positionable in one of said depressions and threadably coupled to one of the first ends of said rods.

5. The assembly according to claim 2, wherein said inner surfaces of said first and second housings are spaced from each other when said first and second housings are in said closed position.

6. The assembly according to claim 5, wherein each said slots in said first and second housings having depth such that said saw blades extend between 0.25 inches and 1.50 inches away from a respective one of said top sides.

7. The assembly according to claim 6, further including a handle being attached to said outer surface of said first housing.

8. The assembly according to claim 7, further including a latch assembly being attached to said first and second housings for selectively securing said first and second housings in said closed position.

9. The assembly according to claim 1, wherein each of said slots in said first and second housings being angled from said inner side to said outer side as each of said slots extends toward said bottom side.

10. The assembly according to claim 1, wherein each said slots in said first and second housings has a depth adapted for receiving said saw blades such that the saw blades extend between 0.25 inches and 1.50 inches away from a respective one of said top sides.

11. The assembly according to claim 1, further including a handle being attached to said outer surface of said first housing.

12. The assembly according to claim 11, further including a latch assembly being attached to said first and second housings for selectively securing said first and second housings in said closed position.

13. A container assembly adapted for holding a plurality circular saw blades, said assembly comprising:

a panel having a generally rectangular shape and having a first edge, a second edge, a third edge and a fourth edge, said first and second edges being positioned opposite of each other;

a first housing having a bottom side, a top side, a inner side, an outer side and a pair of lateral sides, said top side of said first housing having a plurality of slots therein, each of said slots being orientated perpendicular to said lateral sides of said first housing, a juncture of said inner and bottom sides of said first housing being hingedly coupled to said first edge, each of said slots in said first housing being angled from said inner side to said outer side as each of said slots extends toward said bottom side, said first housing having an aperture extending therethrough, said aperture extending into said outer side and outwardly through said inner side, said aperture being generally centrally located in said outer and inner sides such that said aperture extends through each of said slots in said first housing;

a second housing having a bottom side, a top side, a inner side, an outer side and a pair of lateral sides, said top side of said second housing having a plurality of slots therein, each of said slots being orientated perpendicular to said lateral sides of said second housing, a juncture of said inner and bottom sides of said second housing being hingedly coupled to said second edge, each of said slots in said second housing being angled from said inner side to said outer side as each of said slots extends toward said bottom side, said second housing having an aperture extending therethrough, said aperture extending into said outer side and outwardly through said inner side, said aperture being generally centrally located in said outer and inner sides such that said aperture extends through each of said slots in said second housing, wherein each of said inner sides of said first and second housings may be abutted against said panel such that said top sides of said first and second housings are directed toward each other and a closed position is defined, said inner surfaces of said first and second housings being spaced from each other when said first and second housings are in said closed position, said slots in said first housing being staggered with respect to said slots in said second housing when said top sides are facing each other;

wherein each of a plurality of saw blades may be removably extended into one of said slots, openings extending through each of the blades may be aligned with a corresponding one of said one of said apertures, wherein each of the saw blades positioned in said first housing are interspersed between adjacent ones of the saw blades in said second housing due to said slots in said first housing being vertically staggered with respect to said slots in said second housing, each said slots in said first and second housings having a depth adapted for receiving the saw blades such that said saw blades extend between 0.25 inches and 1.50 inches away from a respective one of said top sides;

a pair of rods, each of said rods being removably extendable through one of said apertures and through aligned ones of said openings such that the saw blades are releasably secured in said slots, each of said rods having a first end having a head attached thereto and a second end being threaded, wherein said head may be abutted against one of said outer sides such that said second end is positioned adjacent to a corresponding one of said inner sides, each of said inner sides having a depression therein, said depressions being positioned such that each of said apertures extends through one of said depressions, each of a pair of nuts being positionable in one of said depressions and threadably coupled to one of said first ends of said rods;

a handle being attached to said outer surface of said first housing; and a latch assembly being attached to said first and second housings for selectively securing said first and second housings in said closed position.

* * * * *